United States Patent [19]

Moland

[11] Patent Number: 4,865,118

[45] Date of Patent: Sep. 12, 1989

[54] HEATING, VENTILATING AND AIR CONDITIONING SYSTEM

[76] Inventor: Clarence E. Moland, 1187 Campbell Ave., West Haven, Conn. 06516

[21] Appl. No.: 122,767

[22] Filed: Nov. 19, 1987

[51] Int. Cl.[4] ..... F25B 29/00

[52] U.S. Cl. ..... 165/12; 62/180; 62/332; 165/16

[58] Field of Search ..... 165/16, 27, 21, 12; 62/180, 332; 236/DIG. 19; 98/94.6

[56] References Cited

U.S. PATENT DOCUMENTS

| | | | |
|---|---|---|---|
| 1,819,643 | 8/1931 | Fleisher . | |
| 2,048,137 | 7/1936 | Palmer . | |
| 2,100,110 | 11/1937 | Smith et al. . | |
| 2,243,281 | 5/1941 | Magney . | |
| 2,506,448 | 2/1950 | Gregor . | |
| 2,559,217 | 7/1951 | Kehoe . | |
| 2,657,543 | 11/1953 | Eichmann . | |
| 2,739,794 | 3/1956 | Graham . | |
| 2,823,015 | 2/1958 | Whitlow . | |
| 2,969,652 | 1/1961 | Blanchard | 62/157 |
| 3,067,487 | 12/1962 | McFarlan | 62/159 |
| 3,625,022 | 12/1971 | Johnson | 62/159 |
| 3,938,348 | 2/1976 | Rickert | 62/262 |
| 4,250,956 | 2/1981 | Ohtani | 165/36 |
| 4,401,149 | 8/1983 | Iijima et al. | 165/2 |
| 4,459,816 | 7/1984 | Lung et al. | 62/183 |
| 4,485,632 | 12/1984 | Gallagher | 165/16 X |
| 4,676,073 | 6/1987 | Lawrence | 165/12 X |

*Primary Examiner*—William E. Wayner

*Attorney, Agent, or Firm*—Robert H. Montgomery

[57] ABSTRACT

A climate control system, heating, ventilating, air conditioning, designed for air conditioning and ventilating in which outside air is periodically sampled and may be used for improved ventilating and room cooling with outside air to reduce compressor duty cycle, depending on the temperature and the set point of cooling and ventilating thermostats. The heating, in conjunction with a steam humidifier, is equally beneficial.

26 Claims, 3 Drawing Sheets

HEATING, VENTILATING AND AIR CONDITIONING SYSTEM

FIELD OF THE INVENTION

This invention relates to air treating apparatus for controlling parameters thereof, such as heating and cooling, humidification, and dehumidification.

BACKGROUND OF THE INVENTION

Air conditioning devices are well known, which will both heat and cool air. Typical examples are the well known air conditioning units which will cool and dehumidify outside air passed therethrough, or air recirculated therethrough within a room. Such devices may also include a heating coil for use in the seasons when cooled air is not desired.

These known units are placed in a mode manually by an operator and may include a thermostat which merely amounts to a rotary selector between maximum heat and minimum heat, and the operator must select between recirculation and introduction of fresh air. Additionally, these known units may be operated only in a ventilation mode to supply fresh air without heating or cooling, or to exhaust air from a room.

Some large systems (not window) may also sense the temperature of the outside air and utilize this as a function in controlling a heating, air conditioning, and ventilation system. However, this is usually done only in large central control systems.

The present invention provides a new and improved heating, air conditioning and ventilating system which provides more efficiency as a window type unit, and utilizes larger quantities of outdoor air and therefore improves ventilation, and also lowers operating costs by utilizing a special air sampling technique.

SUMMARY OF THE INVENTION

Briefly stated, the invention in one form thereof comprises a housing member adapted to be fitted to a window of a structure or a port made especially therefor, and is arranged to receive air either from the room or from the outside, and move the air over one or more air treating devices, such as a cooling coil or heater and discharge the air through an outlet port into the room. In a preferred form of the invention, a shutter moves between one or two positions to close either an outside air window or an inside window, and thus determine from where the air to be treated is derived. Starting a cooling cycle, the shutter closes the outside window and a timer is energized at the start of this cycle, and air recirculates through the system. However, periodically, the shutter will automatically close or essentially close the room side window at the ending of a timing cycle and open the outside window, so that fresh air is brought through the system. This is termed a periodic ventilating and outdoor air sampling cycle, which is terminated thermostatically by the heating or cooling controls, depending upon the mode in which the unit is in. Assuming the system is in a cooling operation when a ventilating cycle begins, the cooling coil is very cold and has large cooling capacity, allowing much outside air to pass through it before its temperature rises to near room temperature. This will produce a relatively long ventilating cycle. This assumes that the temperature within the room is lower than that of the outside air. In contrast, when the system is in a heating mode and it is substantially colder outside than inside, the heating element will cool fairly quickly, creating a relatively short ventilating cycle. Means are provided to satisfy the cooling thermostat and the heating thermostat, depending on the mode, to assure a ventilating cycle periodically regardless of room temperature or outdoor temperature. If outdoor air is unsuitable, the unit will revert to the set mode.

Thus, the system primarily utilizes outdoor air for cooling, and the mechanical refrigeration is used primarily for extremely hot weather conditions and for dehumidification. This provides a large saving in energy and enhances health conditions by periodically bringing in fresh air. The system samples the outside air by periodically actually attempting to use it. This provides maximum ventilation, maximum use of outside air for cooling, outdoor air sampling, defrosting of the cooling coil, and automatic control of all intake and recirculating air.

The system is designed to automatically adjust to any indoor and outdoor weather condition, without any manual controlling except to adjust the temperature to the user's comfort. The system may also have its own humidification and dehumidification systems that will maintain constant relative humidity on a year-round basis, depending upon humidistat set points.

Physically, a unit embodying the invention includes an air moving means in the form of a blower which draws air through the unit and discharges the air into a room through an exit port. The entering air first passes through a filter and a cooling coil of a refrigeration unit, then heating coils, and over a steam generator used for humidification. A unit embodying the invention is equipped with air parameter sensors which monitor the room air and supply signals to the air parameter controls to achieve the desired air treatment including the ventilation cycle.

An object of this invention is to provide a new and improved system for controlling the treatment of air within a structure.

Another object of this invention is to provide an air conditioning and treating system which is more economical in operation.

A further object of this invention is to provide an air conditioning and treating system in which the outside air is periodically sampled, and the system then operates in response to a parameter of the outside air in relation to the same parameter of the inside air.

A still further object of this invention is to provide an air treating system which maximizes the use of outside air for cooling and ventilation.

The feature of the invention which are believed to be novel are particularly pointed out and distinctly claimed in the concluding portion of the specification. The invention, however, together with further objects and advantages thereof, may best be appreciated by reference to the following detailed description taken in conjunction with the drawings.

DETAILED DESCRIPTION OF PREFERRED EMBODIMENT OF THE INVENTION

Figure 1:
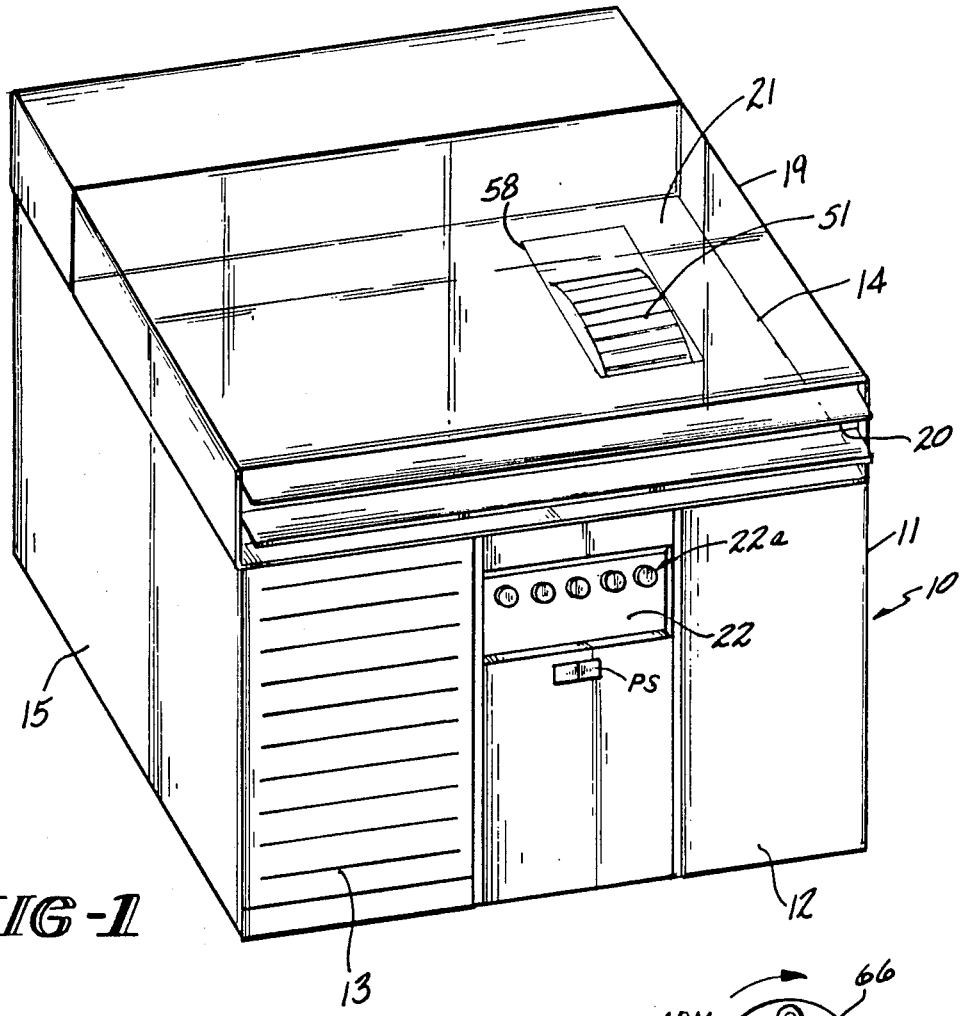
FIG. 1 is a perspective view of unit in which th invention is housed.
Figure 2:
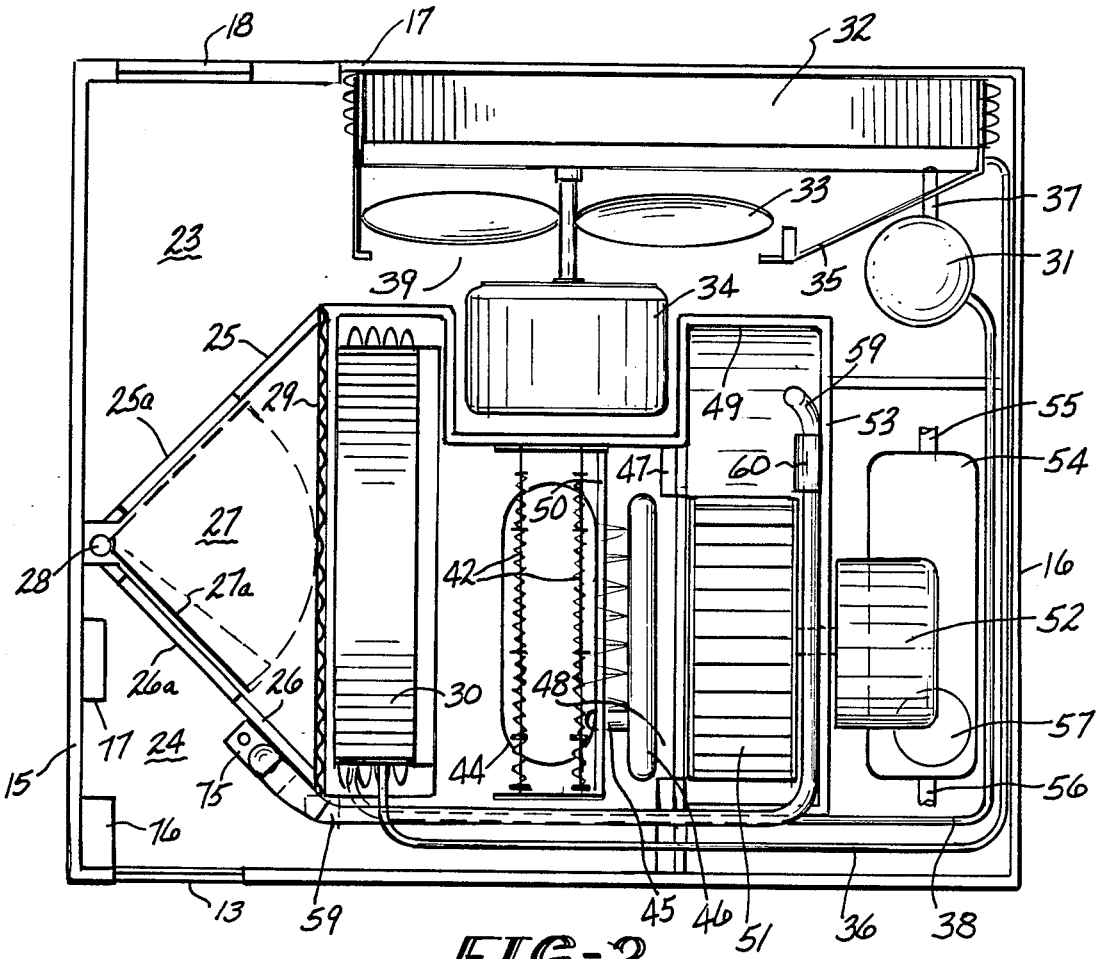
FIG. 2 is a top view of the device of FIG. 1 with the top wall and plenum cover thereof removed.
Figure 3:
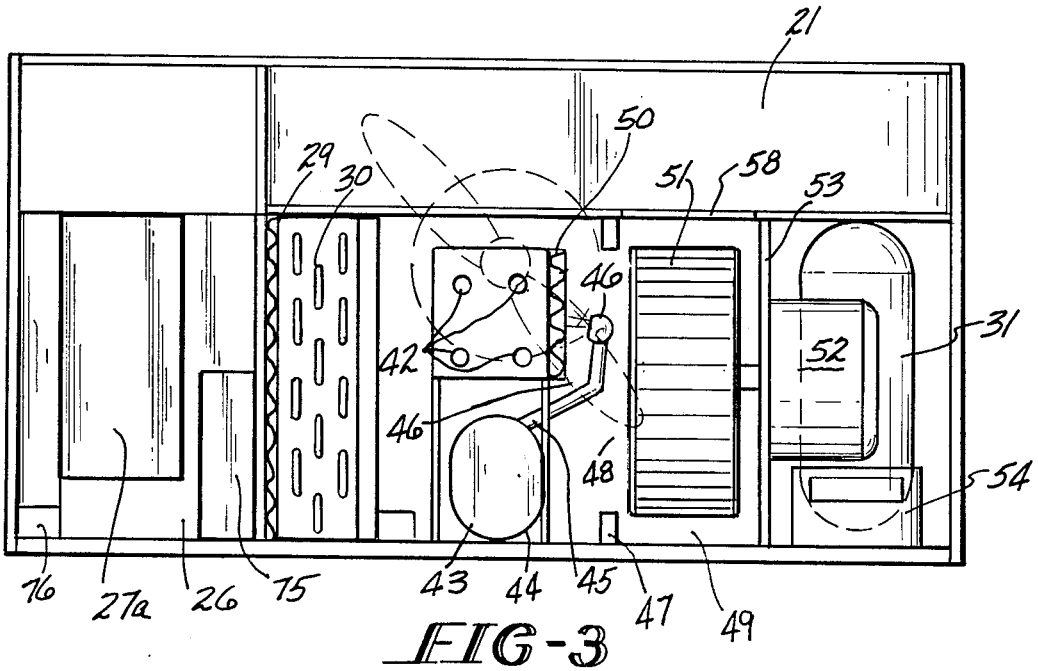
FIG. 3 is a front view of the unit of FIG. 1 with the front cover removed.

A unit 10 embodying the invention as shown in FIGS. 1 and 2 comprises a housing member 11 having a front wall 12 with louvers 13 defined in a portion of wall 12 for entrance of air into housing 11. The unit further comprises a top wall 14 and side walls 15 and 16 and a partial back wall 17. Louvers 18 are defined in a portion of back wall 17 to permit entrance of air therein. A cover member 19 is fitted over the top of the unit and has an outlet 20 defined therein to permit exit of air from the unit from a plenum 21 defined by top wall 14 and cover member 19. An indicating panel 22 may be provided on the unit for purposes hereinafter described, together with a master ON-OFF switch PS, as hereinafter described.

Defined within the housing 11 are chambers 23 and 24 through which inlet air may enter the housing. Chamber 23 through louvers 18 will communicate with the outside air, while chamber 24 through louvers 13 will communicate with the air within the structure. Adjustable separator means, not shown, may be provided between front wall 12 and back wall 17 to fill an opening or window in the structure in which the unit 10 mounted, as in the case of conventional window air conditioning units. Partitions 25 and 26 define a generally triangular shaped chamber 27, as shown in FIG. 2. Partitions 25 and 26 have opening **25*a* and 26*a* defined therein, to permit air to enter into chamber 27 from either chamber 23 or 24. A shutter 27*a* is pivotally mounted at 28 and driven between positions as shown in full line and dotted line to selectively open and close windows 25*a* and 26*a* in partitions 25 and 26, respectively, and determine the direction of air entering chamber 27. The position of shutter 27*a*** is determined as hereinafter described.

In another embodiment of the invention, the shutter **27*a* may not completely close window 26*a*, but leave it open to permit up to about twenty percent of the air flow through the unit to be from air recirculated from the room. The position of shutter 27*a* in such instance is shown in dotted line in FIG. 2**.

Chamber 27 is further defined by a removable filter 29 which is positioned in front of an evaporator or cooling coil 30 of a refrigeration unit which further includes a compressor 31, condensor 32, and a condensor fan 33 and condensor fan motor 34. The condensor 32 and fan 33 are isolated in a compartment defined by a partition 35. The cooling coil 30 is connected to condensor 32 by a fluid line 36 and the condensor is connected to compressor 31 by a fluid line 37. A refrigerant is circulated from compressor 31 to condensor 32, then cooling coil 30, and back to compressor 31 in fluid line 38. The partial back wall 17 is to expose condenser 32 to the outside. The refrigerant is conventionally freon and the refrigeration system described operates in a normal refrigeration cycle. Fan 33 draws outside air through opening 39 in partition 35 and blows it through condensor 32.

Disposed to the right of cooling coil 30 (as shown in FIG. 2) are a plurality of electrical heating coils 42, which may be energized for heating purposes, as hereinafter described. Disposed beneath coils 42 is a steam generator 43 which comprises a tank 44 into which water is introduced. The steam generator further comprises a lead tube 45 which extends from tank 44 to a manifold 46 having a plurality of steam jets defined therein adapted to direct steam into the air flow so that the steam is drawn over the hot manifold 46 to produce dry steam. The steam generator 43 includes a heating element (not shown in FIG. 2). Disposed behind manifold 46 is a partition 47 having an opening 48 therein for entry of air into blower compartment 49. A heat absorbing member 50 is supported just behind heating coils 42. Heat absorbing member 50 may be of a screen-like construction of ceramic material which absorbs heat for later release, as hereinafter described.

Manifold 46 is as close as possible to opening 48 so that the dry steam is immediately presented to a blower 51.

Compartment 49 is defined to the right of partition 47 and includes therein a blower 51 driven by a motor 52 mounted to wall 53 of compartment 49. A water reservoir 54 is provided which has a lead line 55 for entrance of water therein from a source (not shown) and a line 56 to provide water to steam generator 43. Reservoir 54 contains a float valve 57 for operating a water cut-off valve (not shown) to maintain water level in steam generator 43. An overflow stand-pipe (not shown) is provided in reservoir 54 in case of cut-off malfunction. A float 57 may also operate a low water cut-off switch as hereinafter described.

In operation, air will be drawn into the housing through one of openings **25*a* or 26*a* through filter 29, pass through cooling coil 30, heating coils 42, heat absorbing member 50, and the steam generator 43 by blower 51, which then expels the air that has been treated by one of the devices through an opening 58 in top wall 14, shown in FIG. 1**.

Means are provided for conveying treated air to a cooling thermostat as hereinafter described. An air duct 59 receives air from blower 51 and conveys such air to a motorized valve 60 which is periodically opened, as hereinafter described. Duct 59 has an open end and receives air from blower 51. Duct 59 leads from valve 60 to a cooling thermostat hereinafter described.

In operation, the air moving either through opening **25*a* or 26*a*, chamber 27 and hence pass through cooling coil 30, heating coils 42 and steam generator 43 will be acted upon only by one of cooling coil 30 or heating coils 42 and in some instances, steam generator 43. The heating coils 42 and steam generator 43** may operate simultaneously but only when steam is needed for humidification, as will hereinafter be made apparent. Heat and steam can, and do work independently, depending on the controls set point.

The system in a recirculating mode will operate with the shutter **27*a* in the broken line position (FIG. 2) during a cooling or heating cycle so that air is recirculated through the room in which the unit is placed. The system is so designed that periodically the shutter 27*a* will move to the full or dotted line position shown in FIG. 2, and outside air will be brought into the unit, and mixed with room air. The percentage of room air passing through the unit may be about twenty percent or less when shutter 27*a*** is in the dotted line position. This is to cause room air to pass over the heating, cooling thermostats and humidistats as hereinafter described. In a cooling mode of operation, outside air may be utilized a great deal of the time when the temperature of the outside air falls below the set point of the cooling thermostat. Then, the refrigeration system is not utilized.

The operation of a system embodying the invention is hereinafter described in detail in conjunction with FIGS. 4, 5 and 6. To preface this detailed description an overall general description is first set forth. When operating in either a cooling mode or a heating mode, the system is periodically vented to the outside to sample the outside air both as to temperature and humidity. The sampling is performed by thermostats and humidistats within housing 11 on the basis of room air conditions. Depending on these sampled conditions, the unit may remain in a ventilating cycle for a long period of time. For example, during a cooling mode if the outside air is sensed to be at a temperature which is less than the set point of the cooling thermostat, the system will remain in a ventilating cycle until the temperature is sensed to be above the cooling thermostat set point or possibly the humidification humidistat calls for dehumidifying. This may occur during the evening of a season when the system is in a cooling mode and the refrigeration system will be shut down until the temperature may rise the following morning.

Similarly the same thing may occur when the system is in a heating mode when the outside temperature varies about the heating thermostat set point.

A system embodying the invention may find its greatest utility during a cooling season and need not include the heating and humidification capabilities hereinafter described. However, these capabilities may be included in a system embodying the invention at only slightly increased cost of the unit.

The humidifier plays a vital role in cost savings, because it permits the heat thermostat to be set several degrees lower, and yet sustain a very comfortable room environment, and may even decrease cost. Testing has shown that when the air is dry and not so cold, only the steam generator runs for hours, with the heat cycle off.

Figure 4:
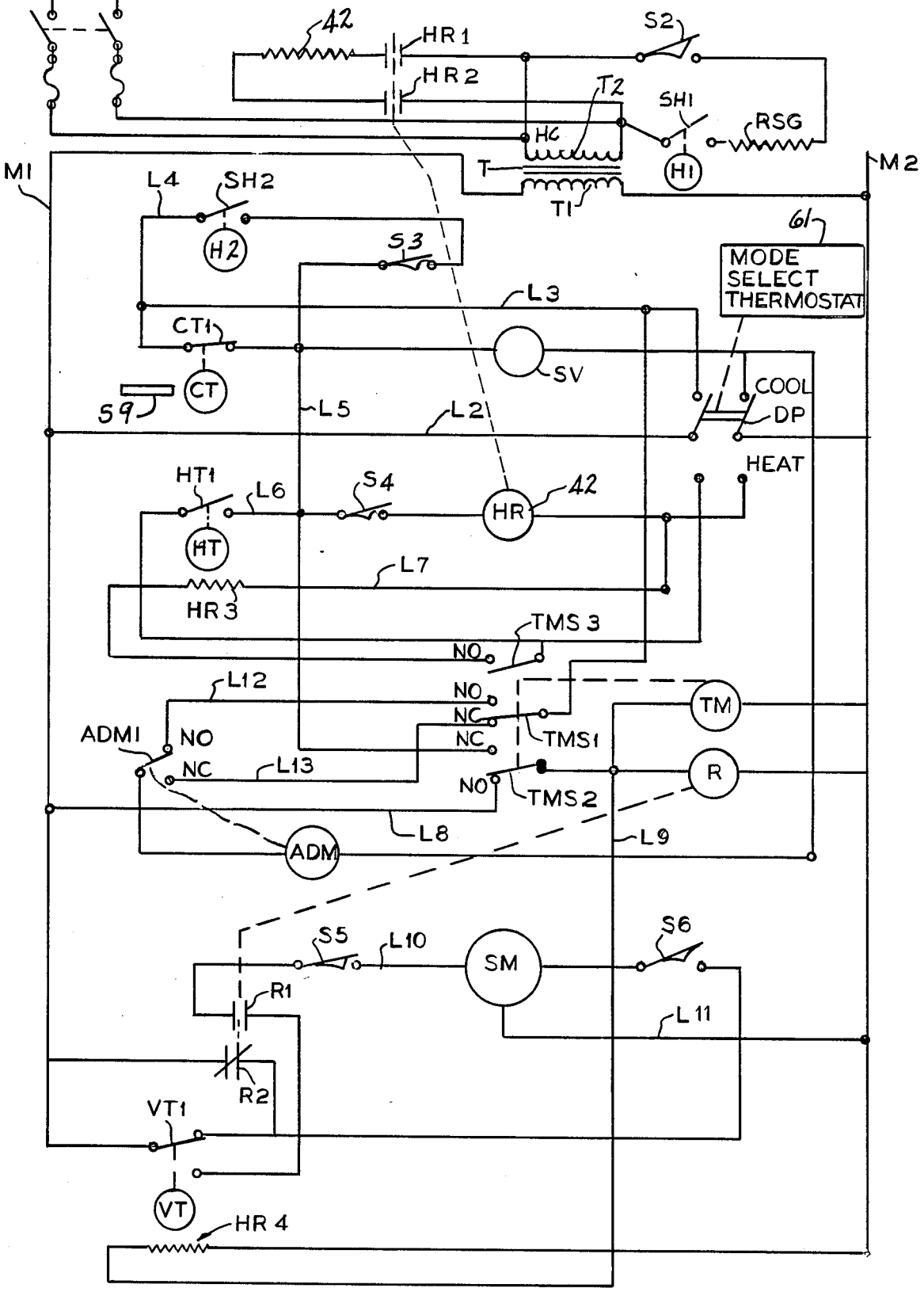
FIG. 4 is a schematic diagram of control circuitry utilized in the invention.

Reference is now made to FIG. 4 which is the electrical control network for a system embodying the invention. This circuit will first be described with respect to structure and then explained in function with respect to the various modes of operation of the invention. A line L2 contains the movable contacts of a double throw switch DP which are connected between lines Ml and M2. As shown, switch DP is in the cooling mode select position. The change over switch is preferably a thermostatically controlled switch responsive to a change over or mode selector thermostat 61 which will be placed in a cooling mode when the outside temperature reaches a predetermined value and in the heating mode when the outside temperature is below the predetermined value. In the position shown for a cooling mode, line L2 is connected to a line L3, leading to a switch arm CT1 of a cooling thermostat CT. When closed, switch CT1 energizes a solenoid valve SV so freon pressure in the refrigeration system will actuate a pressure switch (not shown) to enable compressor 31 and commence operation of the refrigeration system. Line L3 is also connected over line L4 to the switch arm SH2 of a humidistat H2. The switch arm SH2 is shown in a normally open position. When arm SH2 is in its other position, it is connected through a freeze control limit switch S3 to a line L5, as is switch CT1 in its closed position. As will hereinafter be made apparent, line L5 will supply power to other parts of the system when any of switches SH2, CT1 or HT1 is closed.

When switch DP is switched to the heating mode, it will connect the switch arm HT1 of a heating control thermostat HT in line L6 to line Ml and switch HT1 and will energize relay HR which will pick up contacts HRl and HR2 to energize heating elements 42. Switch S4 is a high heat limit switch which will open if the temperature exceeds a predetermined limit. A small heating resistor HR3 is positioned adjacent thermostat HT in line L7 for reasons hereinafter described.

A timing motor TM may be in series with line L5 or with a line L8, depending on the position of a control switch TMS2 which is operated by timing motor TM through a cam as hereinafter described.

The coil of a relay R is connected in a line L9 between lines L8 and M2. This relay controls contacts Rl and R2.

A further circuit is provided for the control of a shutter control motor SM, which moves door 27*a* between the positions shown in FIG. 2. Motor SM is a bi-directional motor in line L10, together with limit switches S5 and S6, which will open the circuit of motor SM when shutter 27*a* is moved from a position closing one of windows 25*a* and 26*a*, to a position which closes the other window. The common line Lll of motor SM is connected to line M2.

Motor SM may be energized through a switch VT1 controlled by a ventilation thermostat VT or contact R2 of relay R for a direction of operation to move shutter 27*a* from the position shown in broken line to the position shown in full line in FIG. 2. For the other direction of operation, motor SM may be energized through switch VT1 and contact Rl of relay R. The switch VT1 of ventilation thermostat VT is shown in the position when a heating resistance HR4 is not energized. When resistance HR4 is energized the heat generated will cause thermostat VT to move switch VT1 to its lower contact and cause motor SM to move shutter 27*a* to the position shown in full line in FIG. 2 when relay R is deenergized and contact Rl drops out (opens).

Timing motor TM also controls a switch TMS1 which will connect an air duct motor ADM in circuit either from line L12 when switch ADM1 is in its NC position and from line L13 when switch ADM1 is in its NO position. Timing motor TM further controls another switch TMS3, which is utilized in the heating mode of operation.

The function of motor ADM is to open valve 60 to permit cool air to blow through air duct 59 on cooling thermostat CT and cause thermostat CT to open its contact CT1 which shuts down the refrigeration system. The purpose of timer motor TM is to drive a timing cam 70 which periodically causes operation of motor SM to open window 25*a* to the outside air.

Figure 5:
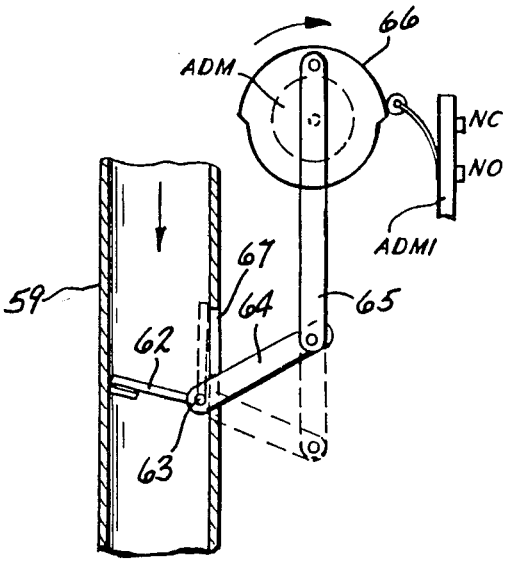
FIG. 5 is a diagram of a shutter control mechanism used in conjunction with the invention.

Reference is now made to FIG. 5 which illustrates the control of air duct 59. Mounted in air duct 59 is valve 60 which includes a shutter member 62 on a pivot 63 which has an arm 64 thereon. Arm 64 is pivoted to one end of link 65 which is driven by air duct motor ADM through a pivotal connection to a cam 66. Cam 66 will operate switch ADM1 which is in circuit with air duct motor ADM in line L12 or line L13 (FIG. 4). As shown, the follower of switch ADM1 is on the high part of cam 66. Motor ADM will stop when the follower drops to the lower part of cam 66 and switch ADM1 moves to its NC contact. Motor ADM will be operated to open shutter 62 and permit flow of air through duct 59 and valve 60 for a short predetermined time, for example, thirty seconds, as hereinafter described. The cam 66 will place switch ADM1 in electrical connection to line L12 when the follower arm rides on the larger radius section of cam 66, and will place switch ADM1 in circuit with line L13 when it returns to the smaller radius of cam 66.

The linkage driven by air duct motor ADM is so selected in length that it merely reciprocates shutter 62 and will close the shutter 62 when again energized. Motor ADM will be energized through line L12 when switch TMS1 is on its NO contact, and motor ADM will drive cam 66 until it changes switch ADM1 to its NC contact, at which time motor ADM will stop. Motor ADM will again be energized through line L13 to close shutter 62 through the NC contact of TMS1 after it drops off cam 70. At this time, switch TMS1 is on its NC contact and motor ADM is energized. A small window 67 is defined in duct 59 to shunt air therethrough when shutter 62 is in the position shown in full line in FIG. 5.

When cold air is passed through duct 59 to cooling thermostat CT, its set point is overridden and it opens its contact CT1 to shut down the refrigeration system. When switch TMS2 drops off of cam 70, relay R is deenergized and its contact R1 picks up. Switch VT1 then starts a ventilating cycle by energizing motor SM through relay contacts R1, line L10 and switch S5 to open outside window 25*a* and allow fresh air to be drawn into the unit and passed on into the room for as long as this air does not raise room temperature higher than the set point of cooling thermostat CT. Until the set point is reached, the system will remain in the ventilation cycle.

Figure 6:
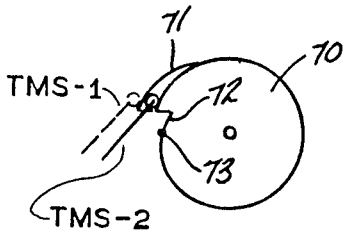
FIG. 6 is a diagram of a timing control for the invention.

Reference is now made to FIG. 6 which exemplifies a timing cam 70, driven by timing motor TM which will operate switches TMS1 and TMS2 and TMS3. Cam 70 has a lobe 71 thereon which will change the position of switches TMS1 and TMS3 (only TMS1 and TMS2 are shown in FIG. 6) for a predetermined time, as for example, thirty seconds. Cam 70 also has a low point 72 which will change the position of all switches TMS1, TMS2 and TMS3, when the follower arms thereof fall therein. Thereafter, switches TMS1 and TMS3 will not change again until another revolution of the cam switch TMS2 will remain on its NC contact after fall off to low point 72, until it is raised to the full radius of cam 70. This is indicated by point 73 on cam 70. Cam 70 and timing motor TM are constructed and arranged so that they will make one revolution in a predetermined period of time, which for purposes of disclosure only, will be considered to be thirty minutes. This is the predetermined time interval for the closing of window 25*a*, and recirculation of the room air through the unit. The system will now be locked in a predetermined mode for the predetermined timing cycle. The ventilating cycle will begin again after the timing cycle when all of switches TMS1, TMS2, and TMS3 fall to low point 72 on cam 70. The ventilating cycle will continue until either the thermostats CT and HT or the humidistat H2 starts timer motor TM again. During a ventilation cycle when the outside air is cooler than the temperature setting of thermostat CT, or warmer than the temperature setting of thermostat HT, as the case may be depending on the mode, the system will be under the control of ventilation thermostat VT, which will determine the position of shutter 27*a*.

Assume now that the system is in a cooling mode with cooling thermostat CT at a given set point. Switch DP is in the cool position and power switch PS is ON. At this time, the refrigeration system is operating to maintain the interior temperature at the cooling set point. The switches TMS1, TMS2, TMS3 and VT1 are shown on their contacts for this condition just before the end of a timing cycle (FIG. 6). Switch VT1 is in the reverse position to that shown in FIG. 4, since heating resistance HR4 is energized. The timer motor TM is energized from line L8 and through the NO contact of switch TMS2. Also, power is supplied to heating resistor HR4 which overrides the set point of ventilating thermostat VT and switch VT1 is at its lower contact but cannot energize motor SM until TMS2 changes position when it falls from cam lobe and causes contacts R1 to close. Heating resistor HR4 was energized at the start of the timing cycle. Heating resistor HR4 has been operating for the entire timing cycle, so VT1 has moved from its upper to its lower contact. Relay R in line L10 is energized and has closed its contact R2 and opened contact R1. Also, at this time, limit switch S5 is closed and shutter 27*a* is in the position shown in broken line in FIG. 2, that is, it closes window 25*a*. The system operating in the cooling mode is now recirculating air from the room therethrough.

Timing motor TM is running and driving cam 70. Near the end of a cycle, lobe 71 will change the position of switch TMS1 and TMS3. This is a small predetermined time, as for example, thirty seconds prior to the fall of switches TMS1, TMS2, and TMS3 on the cam. When switch TMS1 changes position to its NO contact, air duct motor ADM is connected to line L12. When the position of switch TMS1 changes, air duct motor ADM is energized from line L3 through the NO contact of switch TMS1 and the NC contact of switch ADM1. Air duct motor ADM now drives cam 66 and link 65 to open shutter 62 (FIG. 5) until switch ADM1 changes position to its NO contact, at which time, no energy is delivered to motor ADM and it stops. As the shutter 62 in duct 59 opens, cool air is transmitted through duct 59 to the cooling thermostat CT. This is indicated by the terminal end of duct 59 adjacent the cooling thermostat CT in FIG. 4. This will cool the thermostat to less than the set point and turn off the compressor by opening switch CT1 and deenergizing the freon solenoid valve SV. At about this time, cam 70 drops all of switches TMS1, TMS2 and TMS3. Timing motor TM and relay R are now connected through the NC contact of switch TMS2 to line L5 but will be deenergized with switch CT1 open. Also, with the removal of power from line L9, resistor HR4 is still warmer than the set point of ventilating thermostat VT and switch VT1 remains on its lower contact. When relay R is deenergized, it closed contact R1 and opened contact R2. Power is now supplied to motor SM which moves shutter 27*a* to the position shown in full line in FIG. 2. Limit switch S6 closes and limit switch S5 opens.

The purpose of this arrangement is to allow switch VTI to cause shutter 27*a* to move to open window 25*a* while all other systems are inoperative.

After cam 66, driven by motor ADM changes the position of switch ADM1, air duct motor ADM is deenergized and shutter 62 is opened. When both of switches TMS1 and TMS2 fall off the cam, switch TMS1 returns to its NC position and switch TMS2 remains connected to line L5. Thus, motor ADM will be energized over line L13 through the NO contact of switch ADM1 when the follower arm falls to the smaller radius of cam 66 and return air duct shutter 62 to its closed position.

Outside air is now being drawn through the system by blower 51. Cooling coil 30 still has a large cooling capacity and for a time will cool the outside air passing therethrough. When the air in the room raises above the set point of the room thermostat CT, it will close its switch CT1 to energize refrigeration system solenoid valve SV and apply power to line L5. This will energize motor TM, but switch TMS2 will remain at its NC contact on line L5 until it rides up on the cam periphery from cam depression 72, thus locking in the timer through line L8. When CT1 closes, relay R is also energized as is resistance heater HR4. Motor SM is then energized over line L10, since limit switch S5 is closed with shutter 27*a* now closing window 26*a*, and motor SM will move shutter 27*a* to the broken line position shown in FIG. 2 and limit switch S5 will open and limit switch S6 will close. The system will now remain in a recirculating cooling mode unitl the next ventilating cycle.

Assume that the foregoing cycle of operation repeats and the temperature of the outside air has fallen below the set point of thermostat CT. When door 27*a* again moves to the full line position of FIG. 2, it will remain there since the room temperature will not rise and the system will be in a ventilation mode of operation, and motor TM will not be energized, until the room temperature again rises above the set point of thermostat CT or there is a change in the relative humidity above that of the set point of humidistat H2. If the relative humidity in the room should increase above the set point of humidistat H2 and its switch SH2 closes, the system will reenter a cooling mode of operation. This operation will be the same as described before except that line L5 now receives power through switch SH2. A freeze control switch which is temperature responsive will open and shut down the refrigeration system if the temperature should fall to a point to prevent cooling coil freeze-up. Once humidistat H2 is satisfied, the system will revert to the ventilation mode until a thermostat calls for operation.

Motor TM will remain deenergized until the thermostat CT again closes switch CT1 or the humidistat H2 closes its contact in line L4. Then motor TM will drive cam 70 under power from line L5 until TMS2 rides up to the normal periphery of cam 70 from depression 72 and connects motor TM to line L8. If, while in a ventilating cycle, humidistat H2 causes operation of timer motor TM, the system will return to a cooling cycle until the humidistat H2 is satisfied. Switch S3 is temperature sensitive and positioned to sense the temperature at cooling coil 30 and disable humidistat H2 in the event of a freeze-up of cooling coil 30.

In the heating mode of operation, switch DP is reversed from the position shown in FIG. 4 and power is applied to line L5 through the switch HT1 of heating thermostat HT. A resistance heater HR3 is positioned adjacent thermostat HT to override the set point and cause switch HT1 to open when switch TMS3 is actuated by cam lobe 71.

The operation of the shutter 27*a* will be the same as previously described except that the system is under the control of heating thermostat HT. The heat retaining member 50 will act to heat air for a short period of time after the heating elements 42 are turned off and prolong the ventilating cycle.

In a system embodying the invention, the system periodically takes in outside air to sample the outside air as to temperature and humidity, and also to determine if heating or refrigeration is required. This maximizes the use of outside air to provide a more healthful indoor environment. Additionally, when the system switches to ventilation while under the control of cooling thermostat CT, outside air will serve to melt any ice build up on cooling coil 30. If the temperature of the outside air does not exceed the set point of cooling thermostat CT, then the ventilation cycle will continue and the refrigeration system will remain inoperative with switch CT1 open and timer motor TM will not be energized. This provides a substantial energy saving while providing fresh air in the interior room.

In the heating mode during a ventilation cycle, the electrical heating coils will cool very quickly and outside air will be admitted only a short time before element 50 cools, and shutter 27*a* is operated to close window 25*a*. When the relative humidity in the room decreases, humidistat H1 will close its contact SH1 to cause steam generator 43 to introduce steam in the air flow through housing 11 and increase the relative humidity in the room.

The panel 22 may have indicating lights to indicate power-on at switch PS and the modes of operation-cooling, heating humidification, dehumidification, and ventilation. Such lights, as indicated by the reference numeral 22*a* in FIG. 1, are parallel with the respective components being actuated.

The humidistat and thermostats are all located on the room side of partition 26 to sense room air parameters. Such location is represented by reference numeral 75 in FIG. 2. The timer motor TM and cam 70 are located at 76, while the mode select thermostat is at 77. The humidistats and thermostats located at position 75 will be in the path of recirculating room air when shutter 27*a* is in the dotted line embodiment where it does not completely close window 26*a* and permits the recirculating air to be immediately sensed by the thermostats and humidistats.

It may thus be seen that the objects of the invention set forth as well as those made apparent from the foregoing description are efficiently attained. While preferred embodiments have been set forth for purposes of disclosure, modifications of the disclosed embodiments of the invention as well as other embodiments thereof may occur to those skilled in the art. Accordingly, the appended claims are intended to cover all embodiments of the invention and modifications to the disclosed embodiments which do not depart from the spirit and scope of the invention.

Having thus described the invention, what is claimed is:

1. A device adapted to pass air therethrough and modify a parameter of the air passed therethrough and discharge the air passed therethrough into a volume of a structure, said device comprising a housing member having first and second windows arranged to selectively receive air therein, said fir window providing communication with air outside of the structure, and said housing member, said second window providing communication with air in a volume of the structure and said housing member, means for moving air through said housing windows to a discharge port, an air temperature modifying means in said housing member, a pivotally mounted shutter movable between a first position to close said first window and open said second window, and a second position to close said second window and open said first window, means in said housing for changing a parameter of the air passing therethrough, said shutter means being in said first position to recirculate air from the volume through said housing member, reversible drive means for changing the positions of said shutter means, timing means providing a timing cycle and causing said drive means to move said shutter means to said second position at the end of a timing cycle whereby outside air is moved through said housing member, temperature sensing means having a selectable temperature set point, said sensing means being effective to cause said reversible drive means to move said shutter means back to said first position when the temperature of the air reaches or passes the selected set point, means responsive to the end of a timing cycle for temporarily overriding the set point to cause said drive means to move said shutter means to said first position, and means responsive to the end of a timing cycle for disabling said timing means until the sensed air temperature reaches or passes the set point of said temperature sensing means.

2. The device of claim 1 wherein said shutter partially closes said second window when said shutter is operated to open said first window so that a small amount of air from within said structure is mixed with outside air in passing through said housing.

3. The device of claim 1, wherein said air temperature modifying means is an air heating means, said sensing means is a heating thermostat, and a heat retaining means positioned closely adjacent said heating means and adapted to be heated thereby.

4. The device of claim 3 further including a steam generator arranged to humidify air passing through said housing.

5. The device of claim 4 where said steam generator is arranged to direct steam against the air passing through said housing and toward said heat retaining means.

6. The device of claim 4 further including a first humidistat for sensing the relative humidity of the air in said structure and controlling operation of said steam generator in response thereto.

7. The device of claim 1 where, when said shutter means at least partially closes said second window, approximately twenty per cent of the air passing through said housing is from within said structure.

8. The device of claim 1, further including a humidistat for sensing the relative humidity of the air in the structure, said air temperature modifying means comprising a refrigeration system, said humidistat being effective to operate said refrigeration system to reduce the relative humidity in the structure.

9. The device of claim 1, where said air temperature modifying means comprises a refrigeration system, said means for overriding comprises means for subjecting sad air temperature sensing means to cooled air in said housing.

10. The device of claim 1, further comprising a ventilating thermostat, said ventilating thermostat controlling the direction of rotation of said drive means, said ventilating thermostat being effective to hold said shutter means in said second position to open said first window until the temperature in said structure reaches or passes the selected set point of said temperature sensing means.

11. A device adapted to be mounted to a wall of a structure having an inside volume and provide a passage therethrough for recirculating air in the volume and air from without the structure comprising a housing member having first and second windows arranged to receive air therein, said first window providing communication with air outside of the structure and said housing member, said second window providing communication with air in a volume of the structure and said housing member, means for moving air through said housing windows and said passage to a discharge port, and air temperature modifying means in said housing member, a single pivotally mounted shutter movable between a first position to close said first window and open said second window, and a second position to close said second window, and a second position to close said second window and open said first window, said shutter means being in said first position to recirculate air from the volume through said housing member, reversible drive means for changing the positions of said shutter means, timing means providing a timing cycle means responsive to the end of a timing cycle for causing said drive means to move said shutter means to said second position whereby outside air is moved through said housing member, temperature sensing means having a selectable temperature set point, said sensing means being effective to cause said reversible drive means to move said shutter means back to said first position when the temperature of the air reaches or passes the selected set point.

12. The device of claim 11 wherein said shutter partially closes said second window when said shutter is operated to open said first window so that a small amount of air from within said structure is mixed with air outside air in passing through said housing.

13. The device of claim 12 wherein said temperature sensing means is positioned on said housing member to sense the temperature of the air to e recirculated.

14. The device of claim 11 wherein said temperature modifying device is an air heating means, said sensing means is a heating thermostat, and a heat retaining means positioned closely adjacent said heating means and adapted to be heated thereby.

15. The device of claim 14 further including a steam generator arranged to humidify air passing through said housing.

16. The device of claim 15 where said steam generated is arranged to direct steam against the air passing through said housing and toward said heat retaining means.

17. The device of claim 16 further including a humidistat for sensing the relative humidity of air in said structure and controlling operation of said steam generator in response thereto.

18. The device of claim 11 where, when said shutter means at least partially closes said second window, approximately twenty percent of the air passing through said housing is from within the structure.

19. The device of claim 11 wherein said air temperature modifying means is a refrigeration system and further including a humidistat for sensing the relative humidity in the structure.

20. The device of claim 11 where said air temperature modifying means comprises a refrigeration system, and means for overriding the set point of said temperature sensing means comprising means for subjecting said cooling thermostat to cooled air in said housing just prior to the end of a timing cycle.

21. The device of claim 11 where said means responsive to the end of a timing cycle comprises a ventilating thermostat, said ventilating thermostat controlling the direction of rotation of said drive means, said ventilating thermostat being effective to hold said shutter means in said second position to open said first window until the temperature in said structure reaches or passes the set point of said temperature sensing means.

22. The device of claim 11 further including means for disabling said air temperature modifying means just prior to the end of a timing cycle.

23. A method of modifying the temperature in a volume of a structure which comprises the steps of:

a. providing a housing member, adapted to be mounted to a wall of a structure and having a passage therethrough and having an air temperature modifying means therein, said housing member having first and second windows arranged to receive air therein for movement through said passage, said first window providing communication with air outside the structure and said passage, said second window providing communication with air in the volume and said passage, means for moving air through said passage from said windows, shutter means movable between a first position to close said second window and pen said first window and vice versa.

b. providing a timing means having a timing cycle, c. providing a temperature sensing means having a selectable temperature set point to sense the temperature of the air within the volume, d. moving said shutter means to said second position to cause outside air to move through said passage until the temperature of air in the volume reaches or passes the set point of said temperature sensing means, and then moving said shutter means to said first position, e. causing said timing means to initiate a timing cycle wherein said temperature modifying means is operative to modify the temperature of the air in said passage, f. determining the end of the timing cycle, and repeating step (d).

24. The method of claim 23 including the further step of, overriding the set point of said temperature sensing means at the end of a timing cycle prior to step (d).

25. The method of claim 23 including the further step of disabling said temperature modifying means just prior to the end of a timing cycle.

26. A device adapted to be mounted to a wall of a structure having an inside volume and provide a passage therethrough for recirculating air in the volume in a recirculation mode of operation and air from without the structure in a ventilating mode of operation comprising a housing member having first and second windows arranged to receive air therein, said first window providing communication with air outside of the structure and said housing member, said second window providing communication with air in a volume of the structure and said housing member, means for moving air through said housing windows and said passage to a discharge port, an air temperature modifying means in said housing member operative to modify the temperature of air in said passage during a recirculating mode of operation, a pivotally mounted shutter movable between a first position to close said first window and open said second window and a second position to close said second window, and open said first window so that ventilating air is moved through the passage, reversible drive means for changing the positions of said shutter means, timing means providing a timing cycle, means for disabling said air temperature modifying means just prior to the end of a timing cycle, means responsive to the end of a timing cycle for energizing said reversible drive means to move said shutter to said second position to open said first window, for a ventilation mode of operation, a ventilating thermostat, said ventilating thermostat being effective to control the position of said shutter when said device is not in a recirculating mode of operation.

* * * * *

UNITED STATES PATENT AND TRADEMARK OFFICE

CERTIFICATE OF CORRECTION

PATENT NO. : 4,865,118

DATED : September 12, 1989

INVENTOR(S) : Clarence E. Moland

It is certified that error appears in the above-identified patent and that said Letters Patent is hereby corrected as shown below:

Column 10, Claim 1. Line 6, delete "fir" and substitute therefor -first-.

Column 11, Claim 9, Line 4, delete "sad" and substitute therefor -said-.

Column 12, Claim 13, Line 3, delete "e" and substitute therefor -be-.

Column 12, Claim 16, Line 1, delete "generated" and substitute therefor -generator-.

Column 13, Claim 21, Line 3, delete "temperature sensing means" and substitute therefor -ventilating thermostat-.

Column 13, Claim 23a, Line 13, delete "pen" and substitute therefor -open-.

Signed and Sealed this

Eighteenth Day of September, 1990

*Attest:*

HARRY F. MANBECK, JR.

*Attesting Officer*

*Commissioner of Patents and Trademarks*